US006745539B1

(12) United States Patent
Heim

(10) Patent No.: US 6,745,539 B1
(45) Date of Patent: Jun. 8, 2004

(54) LATTICE TOWER

(76) Inventor: Fred F. Heim, 4 NW. 30 Rd., Unit 4154, Great Bend, KS (US) 67530

( * ) Notice: Subject to any disclaimer, the term of this patent is extended or adjusted under 35 U.S.C. 154(b) by 0 days.

(21) Appl. No.: 10/389,302

(22) Filed: Mar. 14, 2003

(51) Int. Cl.[7] ..... E04H 12/00

(52) U.S. Cl. ..... 52/651.01; 52/651.07; 52/653.2; 52/726.3

(58) Field of Search ..... 52/724.3, 726.3, 52/736.1, 737.1, 651.01, 651.07, 653.2

(56) References Cited

U.S. PATENT DOCUMENTS 4,637,192 A * 1/1987 Brown ..... 52/632
6,513,299 B1 * 2/2003 Damiano ..... 52/651.02
6,612,088 B1 * 9/2003 Damiano ..... 52/736.4
2002/0162283 A1 * 11/2002 Benson ..... 52/123.1

FOREIGN PATENT DOCUMENTS

GB 2291078 * 1/1996

* cited by examiner

*Primary Examiner*—Ramon O. Ramirez
(74) *Attorney, Agent, or Firm*—Kenneth H. Jack; Davis & Jack, LLC

(57) ABSTRACT

A lattice tower consisting of first, second, and third poles; first, second, and third webs, each web having a proximal end and a distal end, the proximal ends of the webs being fixedly attached to the first, second, and third poles; first, second, and third pluralities of eye plates fixedly attached to the poles, the first, second, and third pluralities of eye plates being arranged in substantially identical vertically extending patterns; fourth, fifth, and sixth pluralities of eye plates fixedly attached to the distal ends of the webs, the fourth, fifth, and sixth pluralities of eye plates being arranged in vertically extending patterns substantially identical to those of the first, second, and third eye plates; and first, second, and third pluralities of eye plate fasteners respectively interconnecting the first and fifth, the second and sixth, and the third and fourth eye plates.

8 Claims, 6 Drawing Sheets

LATTICE TOWER

FIELD OF THE INVENTION

This invention relates to utility towers. More particularly, this invention relates to towers of the type utilized for radio and telephone communication.

BACKGROUND OF THE INVENTION

A typical radio transmission lattice tower comprises a plurality of weldments which are structurally similar to a common triangular truss having three equi-laterally arranged cords, and having a series of alternately angled tie braces or a lattice web spanning therebetween in a typically "zig zagged" pattern. Upper and lower ends of such weldment are typically provided with bolt receiving mounting plates for bolted interconnection with other similar weldments in a vertically extending series.

A drawback or deficiency of lattice tower assemblies which are configured as described above is that they lack space economy during shipment, typically requiring utilization of several flatbed trucks or trailers for transporting such tower segments from a steel fabrication facility to a tower erection site.

The instant inventive lattice tower solves or ameliorates problems noted above by providing series of triplets of substantially flat weldments which are compactly transportable and which are easily assembleable in the field at a tower erection site.

BRIEF SUMMARY OF THE INVENTION

The instant inventive lattice tower preferably comprises a plurality of substantially flat and substantially identical weldments. Each weldment of the inventive lattice tower preferably includes a pole, upper and lower mounting plates welded to upper and lower ends of the pole, a first series or plurality of eye plates welded to the pole in a vertically extending pattern along the length of the pole, a lattice or web of brace members welded to the pole at their proximal ends and extending outwardly from the pole, and a second series or plurality of eye plates welded to the distal end of the web. Necessarily, the second plurality of eye plates is arranged in a vertically extending pattern matching the pattern of the first plurality of eye plates.

The pole of the above described weldment preferably comprises a sectioned steel pipe or tube, and the preferred mounting plates welded to upper and lower ends of the pole sections are preferably vertically apertured for receipt of helically threaded nut and bolt combinations. Abutting alignments of the mounting plates allows several similarly configured poles to be securely bolted together in a vertically extending series matching a desired height of the lattice tower. Pin and sleeve joints, slip joints, and lap joints may be suitably substituted for the preferred abuttingly attached mounting plates.

The first plurality of eye plates of the above described weldment are preferably oriented so that they extend at 600° angles away from the plane of the web. Such eye plates are preferably double apertured. The second plurality of eye plates welded to the distal end of the web is similarly preferably double apertured. The double apertures of the eye plates allows one pair of overlying eyes to be manipulated by a lever (e.g., a rod or punch) rod for plate alignment, allowing the other pair to easily receive an attachment bolt.

Triplets of substantially identical weldments such as described above are conveniently boltable together to form substantially cylindrical structures having cross sectional shapes approximating equi-lateral triangles, such structures being similar to triangular trusses. By abuttingly attaching pole mounting plates, such segments form the vertically extending series of weldments and sections, forming the inventive lattice tower.

A key advantage of the instant inventive lattice tower is that its individual substantially flat weldments are stackable in stratified lots upon truck or trailer beds for compact cost effective transportation from steel fabrication facilities to tower erection sites.

Accordingly, an object of the instant inventive lattice tower is the provision of substantially flat weldments which are assembleable in the field into equi-lateral triangular tower segments, and which are compactly and conveniently stackable and transportable.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
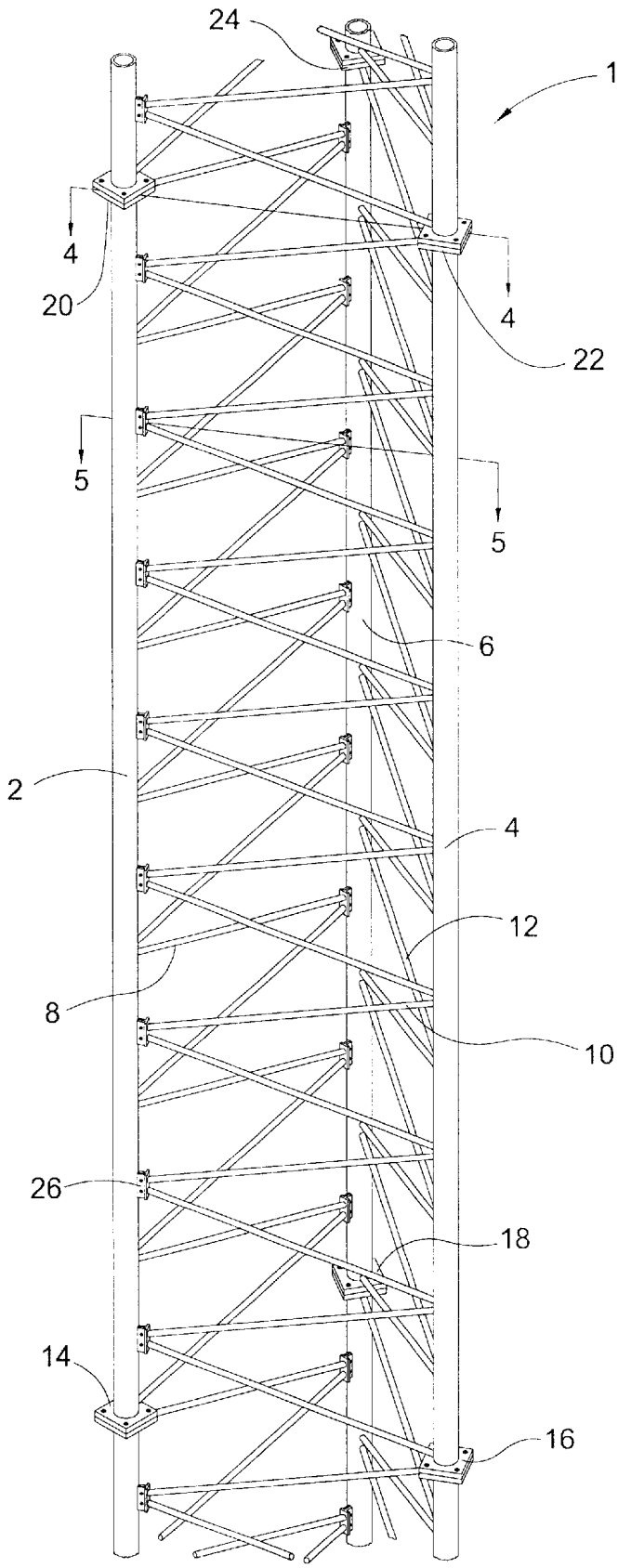
FIG. 1 is an isometric view of a portion of the instant inventive lattice tower.
Figure 5:
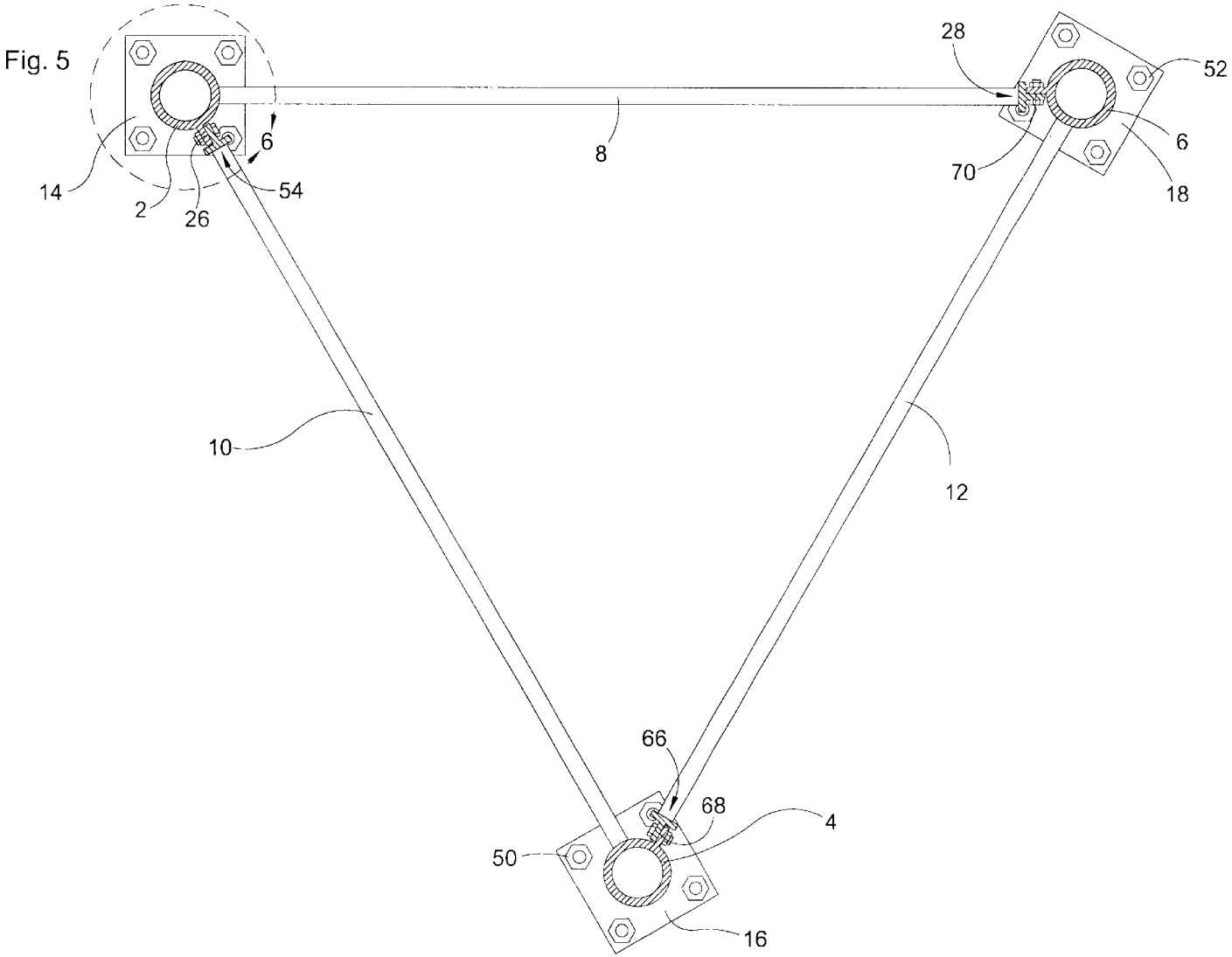
FIG. 5 is an alternate sectional view as indicated in FIG. 1.
Figure 6:
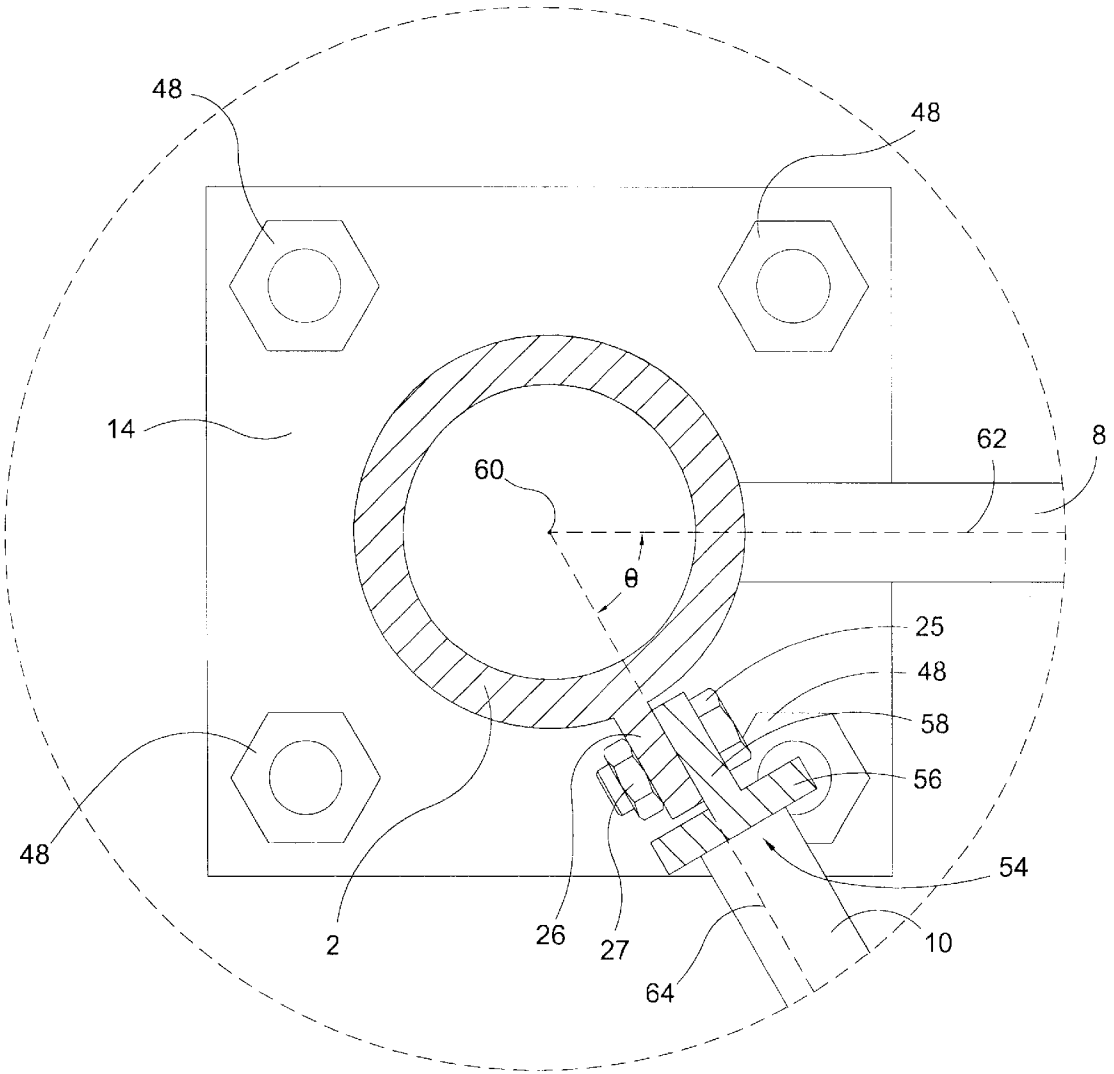
FIG. 6 is a magnified view of a portion of the image of FIG. 5, as indicated in FIG. 5.

Referring now to the drawings, and in particular to FIG. 1, the instant inventive lattice tower is referred to generally by Reference Arrow 1. Major structural components of the lattice tower 1 include vertically extending poles 2, 4, and 6, the poles preferably comprising steel tubing. Referring further to FIGS. 5 and 6, poles 2, 4, and 6 are preferably arranged in an equi-lateral triangular pattern with pole midline points 60 and radially extending reference lines 62 and 64 extending forming three angles θ of approximately 60°. Preferably, the inventive lattice tower 1 comprises an equi-lateral triangular cylindrical structure. Suitably, the inventive lattice tower may be configured pyramidally for free standing support without guy cables.

Referring again to FIG. 1, each of the vertically extending poles 2, 4, and 6 are preferably vertically segmented, the upper and lower ends of each segment of each pole preferably being interconnected by attaching means 14, 16, 18, 20, 22, and 24. Each of the attaching means 14, 16, 18, 20, 22, and 24 preferably comprises abuttingly by paired mounting plates, which are fixedly interconnected by, referring further to FIGS. 4 and 5, helically threaded nut and bolt combinations 42, 44, 46, 48, 50, and 52. While abutting mounting plates 14, 16, 18, 20, 22, and 24 are a preferred pole segment attaching means, other commonly known attaching means such as pin and sleeve joints (not depicted) and lap joints (not depicted) may be suitably substituted.

Figure 2:
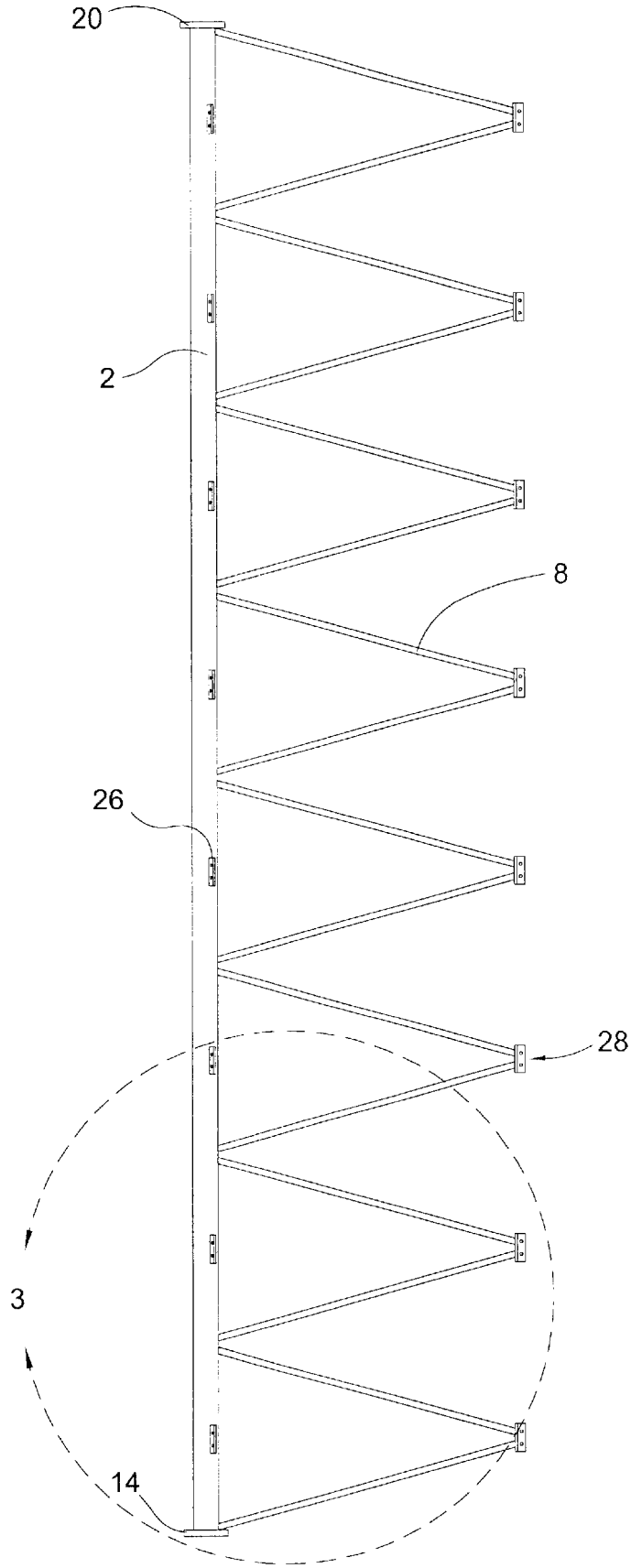
FIG. 2 is a side view of one of the three complete weldments depicted in FIG. 1.

Referring to the single weldment depicted in FIG. 2, a plurality of eye plates 26 are fixedly attached, preferably by means of heat fusion welding, to pole 2. The eye plates 26 are necessarily arranged in a vertically extending pattern along the length of pole 2. The vertically extending pattern of eye plates 26 is preferably evenly spaced along the pole's length, such pattern facilitating attachment of a web having a regular uninterrupted pattern of alternately angled braces. Suitably, though less desirably, the pattern of eye plates 26 may be irregularly spaced. Referring further to FIGS. 1 and 6, pole 4 similarly has welded thereto a plurality of eye plates 68, said eye plates necessarily being arranged in a vertically extending pattern matching that of eye plates 26. Pole 6 similarly has eye plates 70, also arranged in a pattern matching the pattern of eye plates 26.

Referring to FIG. 1, brace lattices or webs 8, 10, and 12 span between poles 2, 4, and 6, each of the webs 8, 10, and 12 preferably comprising a series of alternately angled braces, forming the depicted triangulating "zig zag" patterns. Each of the three webs 8, 10, and 12 have proximal and distal ends, the proximal ends being respectively fixedly attached, preferably by heat fusion welding, to poles 2, 4, and 6.

Figure 3:
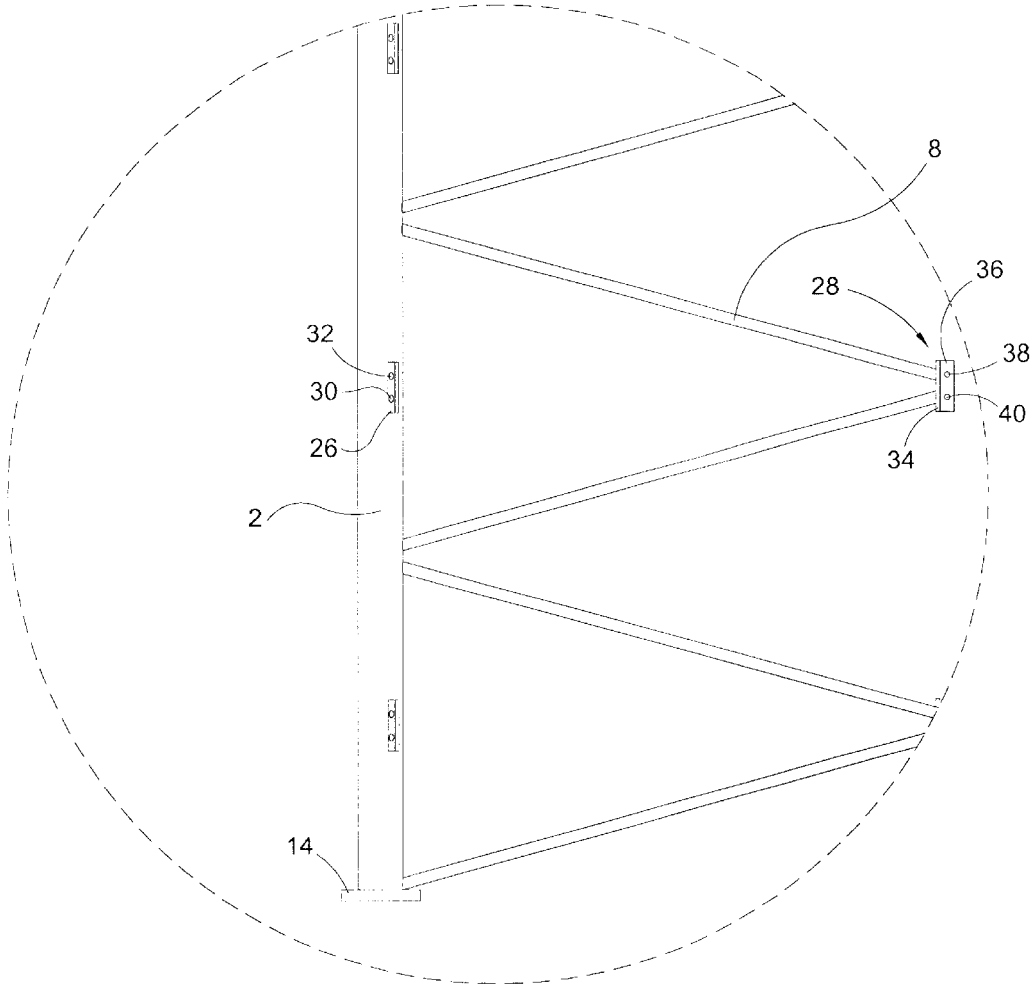
FIG. 3 is a magnified view of a portion of the weldment depicted in FIG. 2 as indicated in FIG. 2.

Referring to FIGS. 2 and 3, a plurality of eye plates 36 are attached to the distal end of web 8 and are arranged there along in a vertically extending pattern which is necessarily substantially identical to the vertically extending pattern of eye plates 26. While the eye plates 36 may be directly fixedly welded to the distal ends of the braces of web 8, eye plates 36 preferably comprise central flanges of "T" beam sections referred to by Reference Arrow 28. Use of "T" beam sections 28 allows such sections "T" flanges 38 to conveniently serve as welding surfaces for attachments of the braces of web 8. Referring further to FIG. 6, the distal end of web 10 similarly has fixedly welded thereto a plurality of "T" beam sections referred to by Reference Arrow 54, each "T" beam section 54 having a welding surface "T" flange 56 and a central eye plate flange 58. The vertically extending pattern of eye plates 58 extending along web 10 is necessarily substantially identical to the vertically extending patterns of eye plates 36 and 26. Referring further to FIG. 5, "T" beam sections.66 attached to web 12 are also arranged in a substantially identical vertically extending pattern.

Referring simultaneously to FIGS. 1 and 5, the vertically extending patterns of "T" beam sections 28, 54, and 66, and the vertically extending patterns of eye plates 68 and 70 are all substantially identical to the vertically extending pattern of eye plates 26.

Referring simultaneously to FIGS. 1 and 3, each of the eye plates utilized throughout the instant inventive lattice tower 1 preferably has paired eyes or bolt receiving apertures arranged similarly with apertures 30 and 32. By so pairing eyes of the eye plates, the eyes serve dual functions for receipt of a lever rod for alignment of plate lap joints, and for receipt of nut and bolt combinations such as nuts and bolts 25 and 27 depicted in FIG. 6.

Referring simultaneously to FIGS. 1 and 2, and assuming that the lateral dimension of the depicted tower is two feet to five feet, the angled cross braces of webs 8, 10, and 12 are preferably spaced and angled so that the midpoints of the braces are vertically spaced at twelve inch to sixteen inch intervals, and so that the web patterns are uninterrupted at junctures of post segments. By spacing the midpoints of the cross braces of the webs at intervals of twelve inches to sixteen inches and by preventing interruptions of the bracing patterns of the webs at the junctures of the pole sections, each web effectively functions as a step ladder for tower maintenance in addition to providing structural bracing. Accordingly, assuming for the sake of example that posts 2, 4, and 6 are spaced approximately four feet apart, the "V" angles of the braces of webs 8, 10, and 12 are preferably 28°–37°. In order to prevent pattern interruptions at junctures of post segments, the spacing of braces at the vertices of the V's is preferably equal to the vertical thicknesses of the mounting plate connections 14–24. Where, for example, each mounting plate is ⅝" thick, the distal and proximal ends of the braces of webs 8, 10, and 12 are preferably spaced 1-¼" apart.

Figure 4:
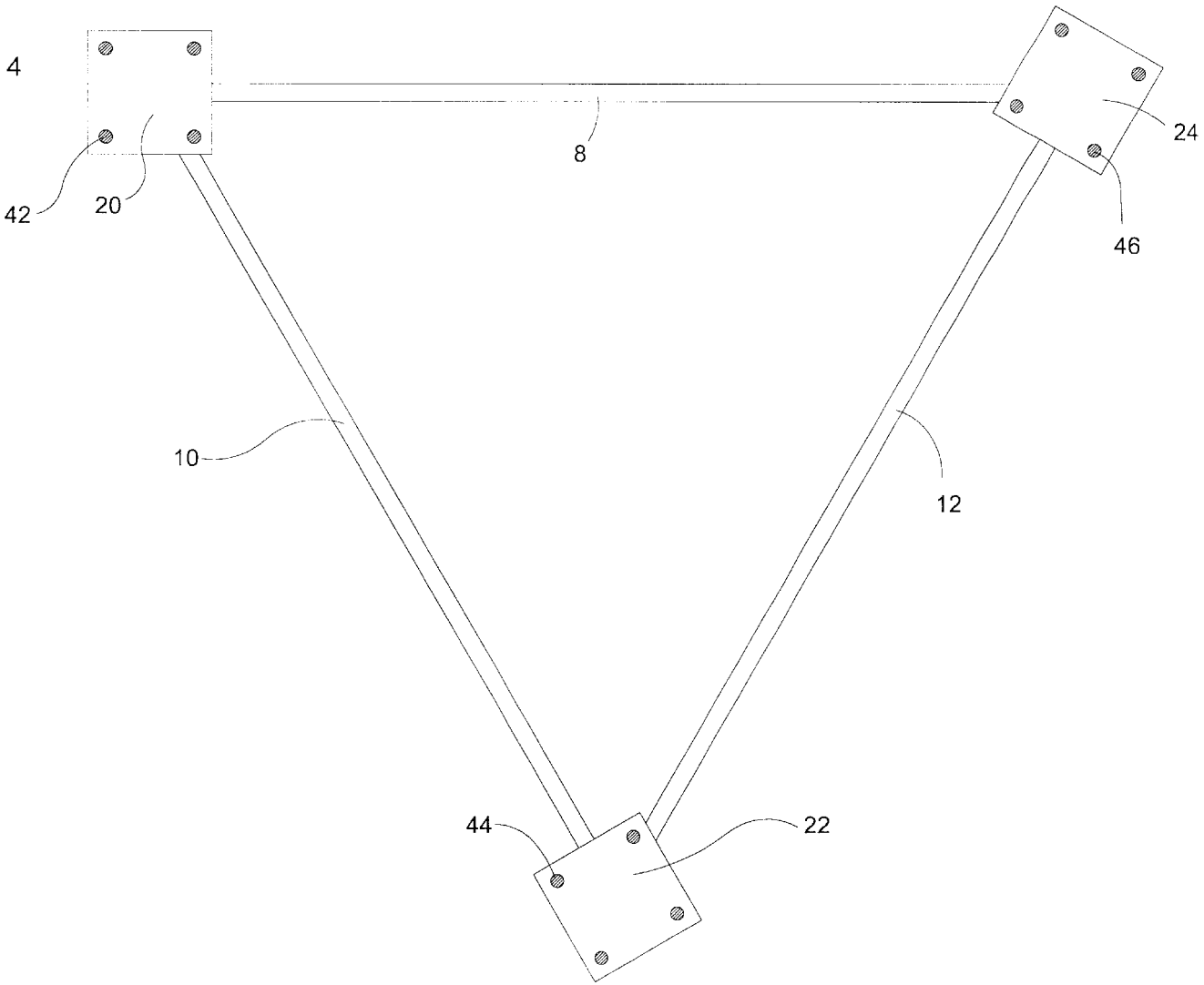
FIG. 4 is a sectional view as indicated in FIG. 1.

For ease of assembly of tower sections, referring to FIGS. 1, 4, and 5, mounting plates 14, 16, 18, 20, 22, and 24 are preferably aligned so that their bolt receiving apertures are in parallel alignment with webs 8, 10, and 12. Such alignment allows the upper and lower ends of webs 8, 10, and 12 to be attached to poles 2, 4, and 6 in close proximity with the mounting plates, preventing web pattern interruption, while facilitating wrench access to mounting bolts.

Referring simultaneously to FIGS. 1 and 2, the substantially flat weldments of the instant inventive lattice tower 1 may be conveniently loaded upon a flat bed truck or trailer with one weldment compactly stacked directly upon another. The instant invention's capacity for compact stacking and shipping reduces the number of shipments needed for transporting an unassembled lattice tower from a steel fabrication facility to an assembly site, promoting cost economies.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A lattice tower comprising:

(a) first, second, and third poles;

(b) first, second, and third webs, each web among the first, second, and third webs having a proximal end and having a distal end, the proximal ends of the first, second, and third webs being respectively fixedly attached to the first, second, and third poles;

(c) first, second, and third pluralities of eye plates respectively fixedly attached to the first, second, and third poles, the first, second, and third pluralities of eye plates being arranged in substantially identical vertically extending patterns;

(d) fourth, fifth, and sixth pluralities of eye plates respectively fixedly attached to the distal ends of the first, second, and third webs, the fourth, fifth, and sixth pluralities of eye plates being arranged in vertically extending patterns substantially identical to those of the first, second, and third pluralities of eye plates; and, (e) first, second, and third pluralities of eye plate fasteners respectively interconnecting the first and fifth, the second and sixth, and the third and fourth pluralities of eye plates.

2. The lattice tower of claim 1, wherein each pole among the first, second, and third poles is vertically segmented, and further comprising pole segment connecting means interconnecting the first, second, and third poles' segments.

3. The lattice tower of claim 2, wherein the pole segment connecting means comprise a plurality of abuttingly joined mounting plates.

4. The lattice tower of claim 3, wherein each web among the first, second, and third webs comprises a plurality of triangulating braces.

5. The lattice tower of claim 4, wherein each triangulating brace has a midpoint, the triangulating braces being positioned so that their midpoints are vertically spaced at twelve inch to sixteen inch intervals.

6. The lattice tower of claim 4, wherein each eye plate fastener among the first, second, and third pluralities of eye plate fasteners comprises a helically threaded nut and bolt combination.

7. The lattice tower of claim 6, wherein each eye plate among the first, second, third, fourth, fifth, and sixth pluralities of eye plates has a pair of bolt receiving apertures extending therethrough.

8. The lattice tower of claim 7, wherein the first, second, and third pluralities of eye plates are respectively oriented so that they extend at sixty degree angles from the first, second, and third webs.

* * * * *